US005920912A

United States Patent [19]

Patchett

[11] Patent Number: 5,920,912

[45] Date of Patent: Jul. 13, 1999

[54] EAR CUFFS

[76] Inventor: Marlene M. Patchett, 628 Augusta Ct., Fullerton, Calif. 92835

[21] Appl. No.: 09/057,330

[22] Filed: Apr. 8, 1998

Related U.S. Application Data

[60] Provisional application No. 60/043,429, Apr. 7, 1997.

[51] Int. Cl.[6] ..... A61F 11/14

[52] U.S. Cl. ..... 2/209; 2/174; 128/866

[58] Field of Search ..... 2/174, 209; 128/864, 128/866

[56] References Cited

U.S. PATENT DOCUMENTS

| | | | |
|---|---|---|---|
| 190,720 | 5/1877 | Kleinert | 2/209 |
| 3,525,103 | 8/1970 | Yonan | 2/174 |
| 5,628,070 | 5/1997 | Kefelian | 2/174 |
| 5,718,001 | 2/1998 | Wright | 2/209 |
| 5,778,455 | 7/1998 | Joseph | 2/209 |

*Primary Examiner*—Diana L. Oleksa
*Attorney, Agent, or Firm*—Cleveland R. Williams

[57] ABSTRACT

The present invention relates to an ear protective device that protects the human ear from being burned by curling irons or hot rollers during the heat treatment of hair. The ear protective device is especially constructed to cover the human ear. The device comprises an outer heat resistant material, an inner soft material connected to the outer material, said outer and inner materials defining a cavity for receiving the human ear, wherein the outer and inner materials or covers have an elastic member attached around the perimeter of said outer and inner materials which define an opening to said cavity.

11 Claims, 1 Drawing Sheet

EAR CUFFS

This appln. claims the benefit of U.S. Provisional Appln. Ser. No. 60/043,429 filed Apr. 7, 1997.

BACKGROUND OF THE INVENTION

1. Field of the Invention

The present invention relates to a protective device for the human ear to protect said ear from being burned by curling irons or hot rollers during heat treatment of said human hair.

Modern Technology has produced hair care aids such as curling irons and hot rollers to heat treat human hair. These hair care aids allow the individual to treat said hair in the home instead of a beauty salon. These hair care aids invariably result in the individual burning his or her ear during the use of said aids.

Thus, it is highly desirable to utilize a device which will protect the ear during the heat treatment of hair using hair care aids. The device which is suitable for use herein comprises ear cuffs which fit around the ear and protect said ear from curling irons, hot rollers and the like. The ear cuffs comprise a heat-resistant, pliable outer material and a soft, inner material connected to the outer material, wherein said ear cuffs are adapted to receive the human ear.

2. Description of the Prior Art

Numerous devices have been employed in the past to protect the human ear from various adverse conditions that would cause discomfort or potential harm to the individual.

For example, U.S. Pat. No. 4,133,052, issued Jan. 9, 1979 to Hodgeman et. al. Relates to a protective arrangement for use in a beauty salon that protects the wearer's forehead. The protective arrangement has a flexible, heat resistant and moisture-resistant cape with a trough at its lower end which is detachable, thus enabling the cape to be held up against the bottom of a hair dryer hood at the back of the wearer's head by an elastic cord. The protective arrangement also has a heat-resistant and moisture resistant head band which substantially covers the wearer's forehead, and in addition, has ear flaps to cover the ears, and a transparent visor to cover the nose and eyes.

U.S. Pat. No. 4,791,684, issued Dec. 20, 1988 to Schwartz describes an ear held earmuff to protect the human ear from cold weather. The earmuff consists of an inner securement member placed over the helix of an outer human ear and an outer muff member sized to cover the outer ear of said individual, which is removably attached to the inner securement member of said earmuff.

U.S. Pat. No. 4,916,758, issued Apr. 17, 1990 to Jordan-Ross discloses a fill ear protector for beauticians' use during liquid treatments of the human hair which may irritate or otherwise cause discomfort to the ear or outer ear canal. The ear protector contains an ear plug to prevent undesirable liquids from entering the ear canal. The ear protector contains absorbent materials on the inside thereof As can be determined from the foregoing, there is an ongoing research effort for more effective and efficient devices to protect the human ear from adverse conditions and liquid compositions.

SUMMARY OF THE INVENTION

The present invention resides in a protective device for the human ear, which protects said human ear from being burned during the application of heat to human hair.

The protective device for the human ear consists of a right member and left member which respectively cover the right and left human ears. Said two members may be connected to each other by a regular string or elastic string to prevent the members from being separated from each other and lost.

Each protective member comprises an outer, pliable "TEFLON" e.g. polytetrafluoroethylene covering or other heat resistant fabric. An inner soft covering is attached to the outer pliable "TEFLON" e.g., polytetrafluoroethylene covering by conventional means, e.g. sewing, gluing, etc. The outer and inner coverings of each member define a cavity which is adapted to receive a human ear. The outer and inner covers have an elastic member, for example rubber, etc., attached around the perimeter of said covers which define an opening to said cavity.

DETAILED DESCRIPTION OF THE INVENTION

The present invention resides in a device which effectively protects the human ear from burning during the application of heat to human hair. The outside covering of the device is preferable constructed from a heat resistant material, while the inside is conveniently constructed from a soft material that is pleasing to the touch.

Figure 1:
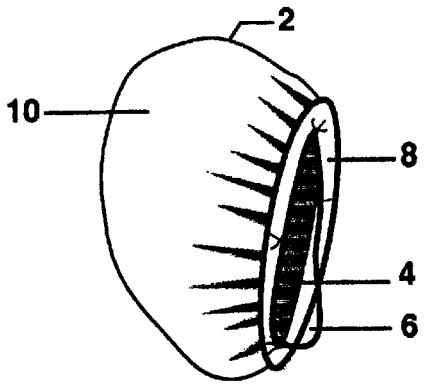
FIG. 1 is a front, perspective view of a single ear protective device.

Turning now to the drawings, FIG. 1 shows a device comprising a single ear cuff (2) which is constructed and adapted to receive a human ear. Ear Cuff (2) contains an outer, pliable heat-resistant material (10), said outer material (10) is an outer covering that is constructed from a heat resistant material such as pliable "TEFLON" e.g. polytetrafluoroethylene or a similar heat resistant material. An inner soft material (4) is connected to outer material (10) by attachment or connection means. Suitable attachment or connection means comprises sewing, bonding, gluing or attachment by heat treating. The inner soft material, preferably is selected from cotton cloth, terry cloth or a blend of soft fabrics.

Outer material (10) and inner material (4) define cavity (8) which is adapted to receive the human ear. Elastic member (6) is attached around the perimeter of outer material (10) and inner material (4) which defines an opening to cavity (8), and wherein said cavity is adapted to receive the human ear.

Figure 2:
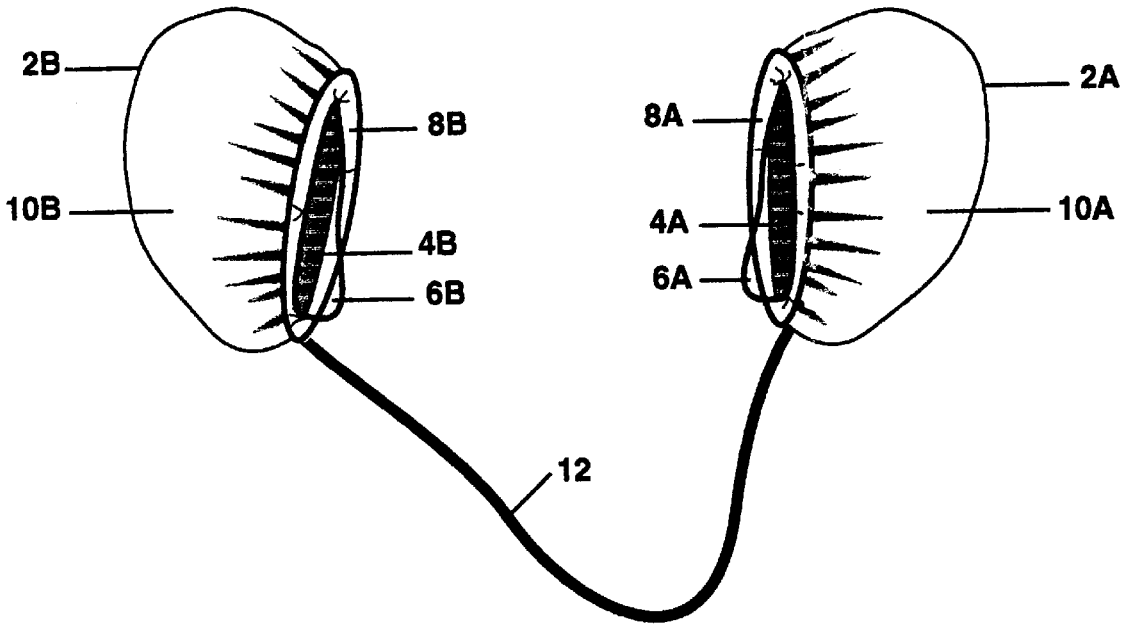
FIG. 2 is a front, perspective view of right and left members of the ear protective device, wherein said members are connected to each other by an elastic member.

FIG. 2 shows right member (2A) and left member (2B) ear cuffs which are substantially similar to the ear cuff of FIG. 1, wherein said ear cuffs (2A and 2B) are constructed to receive the right and left human ear. Ear cuffs (2A and 2B) contain outer members (10A and 10B) which are constructed from a heat-resistant material such as pliable Teflon. Inner soft coverings (4A and 4B) are attached to outer coverings (10A and 10B) by attachment or connection means. Sewing, bonding, gluing or heat treatment define suitable attachment or connection means herein. The inner soft materials (4A and 4B) are preferably constructed from cotton cloth, terry cloth or a blend of soft fabrics.

Outer and inner materials (10A and 10B) and (4A and 4B) define cavities (8A and 8B) which are adapted to receive the human ear. Elastic members (6A and 6B) are attached around the perimeter of outer materials (10A and 10B) and inner materials (4A and 4B) which define openings to cavities (8A and 8B) wherein said cavities (8A and 8B) are adapted to receive the right and left human ears.

Right ear cuff (2A) and left ear cuff (2B) are attached to each other by connecting cord (12) at the opposite ends of said cord (12). It should be noted that connecting cord (12) can preferably be selected from an elastic member such as rubber or string. It should additionally be noted that connecting member (12) is preferably constructed from an elastic material, however, it can be constructed from conventional string type materials.

It should be apparent from the foregoing that modifications and adaptations to the above-described ear cuffs may be made without departing from the inventive concept thereof and therefore only such limitations should be applied thereto as defined and described in the claim language herein.

I claim:

1. A device which protects the human ear during the heat treatment of hair which comprises an outer, pliable heat-resistant material, an inner soft material connected to the outer material, wherein the outer and inner materials define a cavity which is adapted to receive the human ear; and an elastic member attached around the perimeter of the outer and inner materials which defines an opening to said cavity.

2. The device according to claim 1, wherein said device is a heat resistant ear cuff.

3. The device defined in claim 1, wherein the outer, pliable heat-resistant material is polytetrafluoroethylene.

4. The device of claim 1, wherein the inner material is cotton cloth.

5. The device according to claim 1, wherein the outer and inner materials are connected by sewing means.

6. The device described in claim 1, wherein the outer and inner materials are connected by bonding means.

7. The device defined in claim 1, wherein the elastic member is rubber.

8. Two separate, heat-resistant ear cuffs, each of which comprise an outer, pliable heat-resistant material, an inner soft material connected to the outer material with connection means, wherein the connected outer and inner materials define a cavity which is adapted to receive the human ear; and an elastic member attached around the perimeter of the outer and inner materials which defines an opening to said cavity.

9. The heat-resistant ear cuffs described in claim 8, wherein said ear cuffs are attached by an elastic cord.

10. The heat-resistant ear cuffs described in claim 8, wherein said ear cuffs are attached by string.

11. The heat-resistant ear cuffs of claim 8, further comprising an elastic member having its opposite ends attached to each of the two ear cuffs.

* * * * *